US005153951A

United States Patent [19]

Hester

[11] Patent Number: 5,153,951

[45] Date of Patent: Oct. 13, 1992

[54] RECLINER FRAME CONVERTIBLE TO SOFA BED WITH LOCKING CONNECTION BETWEEN SEAT FRAME AND BACK FRAME

[75] Inventor: Dan O. Hester, Sparta, Tenn.

[73] Assignee: Shaffield Industries, Inc., Sparta, Tenn.

[21] Appl. No.: 775,779

[22] Filed: Oct. 11, 1991

[51] Int. Cl.[5] ..... A47C 17/17

[52] U.S. Cl. ..... 5/37.1; 5/47; 5/57.2

[58] Field of Search ..... 5/57.1, 57.2, 47, 48, 5/37.1, 41

[56] References Cited

U.S. PATENT DOCUMENTS

| | | | |
|---|---|---|---|
| 677,671 | 7/1901 | Lausen | 5/57.2 |
| 1,724,457 | 8/1929 | Cummings | 5/57.1 |
| 1,921,622 | 8/1933 | Korth | 5/57.2 |
| 1,936,973 | 11/1933 | Switzer | 5/37.1 |
| 2,294,475 | 9/1942 | McAllister | 5/57.1 |
| 3,049,376 | 8/1962 | Rosenthal . | |
| 3,124,388 | 3/1964 | Berlin . | |
| 4,642,823 | 2/1987 | Wiggins | 5/47 |
| 4,875,244 | 10/1989 | Tremblay | 5/47 |
| 4,996,730 | 3/1991 | Fireman et al. . | |
| 5,083,333 | 1/1992 | Newton | 5/37.1 |

FOREIGN PATENT DOCUMENTS

| | | | |
|---|---|---|---|
| 509133 | 2/1952 | Belgium | 5/47 |
| 173745 | 7/1906 | Fed. Rep. of Germany | 5/37.1 |

*Primary Examiner*—Renee S. Luebke
*Assistant Examiner*—F. Saether
*Attorney, Agent, or Firm*—I. C. Waddey, Jr.

[57] ABSTRACT

My invention is a convertible sofa bed recliner having an improved connection between the seat frame and the back frame which allows an easy conversion from a seating configuration to a sofa configuration and back to the seating configuration with strengthened support in the connection for the structure in both the seating configuration and the bed configuration. My improved connection includes a slot in the rear portion of the side rail of the seat frame so that the pivot pin connecting the seat frame to the back frame can travel along the slot allowing the seat frame to be radially in relation to the pivot pin. When the seat frame is moved radially, it disengages a dowel from a cam on the top of the side rail. The dowel extends inwardly of the back frame from the inside of the end rails of the back frame. Once the dowel is disengaged from the cam, the seat frame can be rotated about the pivot pin so that the back frame and seat frame are in a horizontal position. The seat frame is then pushed toward the back frame and the dowel engages in the slot on the side rail to give a fixed connection between the seat frame and the back frame in the horizontal position to provide a rigid connection between the two and solid support for the frames in the sofa configuration. To convert the structure from a bed configuration to a seat configuration, the process is simply reversed.

3 Claims, 2 Drawing Sheets

RECLINER FRAME CONVERTIBLE TO SOFA BED WITH LOCKING CONNECTION BETWEEN SEAT FRAME AND BACK FRAME

THE BACKGROUND OF THE INVENTION

This invention relates to structures which are designed to serve both a seating function and a sleeping function. The structure is convertible from a sofa or chair configuration to a bed configuration.

The structure of this invention is particularly adaptable for use in conjunction with a futon; the structure of the present invention serving as a frame or support for the futon which itself can serve as a cushion for the structure in a seat configuration or as a mattress for the structure configured as a bed.

The structure of the present invention has a number of advantages of a space saving nature and is particularly adaptable for use by apartment dwellers, in efficiency apartments, and in residences where one room serves multiple purposes. The structure of this invention would allow a user to configure a room as a lounge allowing guests to be seated on the sofa when the structure is configured in a seating arrangement, and at night, to allow the room to be configured as a guest bedroom by converting the structure to a bed configuration.

The convenience of conversion of the structure of the present invention from a seating configuration to a bed configuration is one of its unique features. Similarly, the conversion from the bed configuration back to a seating configuration is quite simple and easily implemented.

During the conversion process, it is not necessary to move the frame of this structure because the back support in the seating configuration moves in such a fashion when the structure is being converted from seating configuration to bed configuration so that the back support does not move in a rearward direction. Thus, the structure may be placed against a wall while fixed in the seating configuration and can be converted to the bed configuration without any movement of the base itself.

The structure of this invention also has means to support the structure when it is in the bed configuration.

Many of the advantages of the structure of this invention are described in U.S. Pat. No. 4,996,730 issued to Robert Fireman and Gary Shaffield. However, the present invention is a substantial improvement over the structure described in U.S. Pat. No. 4,996,730, in two significant respects. First, the connection between the back frame and the seat frame of the structure of this device is a unique improvement which enables one to convert the structure from a seating configuration to a bed configuration with a minimum of effort by pulling forward and upwardly on the seat frame until the back frame is lying in a horizontal position. The relative relationships between the back frame and the seat frame are maintained during this rotation by the unique connection between the two frames. Secondly, the unique connection between the two frames is one which allows for the creation of a rigid connection between the seat frame and the back frame once the structure is in the bed configuration. This fixed connection between the two frames when the structure is in the bed configuration prevents the bed from tipping over or from collapsing and folding about a person when sleeping on the bed.

The unique connection between the back frame and the seat frame of this structure includes a slotted side rail which allows the seat frame to be moved radially in relationship to the pivot pin connecting the seat frame and back frame as well as rotating about the pivot pin. When the seat frame is moved radially in relationship to the pivot pin, it either engages a dowel extending from the back frame against a cam provided on the top of the side rail or it disengages the same. When the seat frame is pulled forwardly or upwardly in relationship to the pivot pin, the dowel disengages from the cam which allows the seat frame to rotate about the pivot pin into a horizontal position so that the structure can be configured as a bed. The seat frame is then pushed backwardly against the back frame with the dowel engaging in the slot provided in the side rail to create a fixed connection between the seat frame and the back frame.

In converting the structure from a bed configuration to a seat configuration, the seat frame is pulled forwardly to disengage the dowel from the slot. The seat frame is then rotated about the pivot pin and once the dowel clears the rear rail of the seat frame, the seat frame is pushed rearwardly or downwardly so that the dowel engages the cam provided on the top of the side rail. Once the dowel engages the cam, a fixed connection between the seat frame and the back frame in the seat configuration is created allowing the seat frame to be pushed downwardly to rotate the entire structure into the the seating configuration.

DESCRIPTION OF THE PRIOR ART

The prior art pertinent to this invention consists primarily of U.S. Pat. No. 4,996,730, which illustrates a structure having many of the same features as the present invention. However, this patent fails to provide a connecting structure of the type disclosed in this application connecting the seat frame to the back frame in a manner that will allow the structure to be conveniently converted from a seating configuration to a bed configuration or vice versa, while at the same time enabling a rigid fixed relationship to be established between those two frames in either configuration. The prior art described in U.S. Pat. No. 4,996,730 is designed to meet some of the more elementary objectives of the present invention but fails to disclose the specific connecting structure between the seat frame and back frame as is unique to the present invention.

Patents which show slotted connections between a seat portion and back portion of a structure convertible from a seat to a bed are also illustrated in the patent to Berlin, U.S. Pat. No. 3,124,388 and in the patent to Rosenthal, U.S. Pat. No. 3,049,376. However, these patents are far more complicated than the structure of the present invention and fail to provide a simple structural arrangement that connects the seat frame and the back frame in a convertible relationship that can be operated with a minimum of effort and complication.

SUMMARY OF THE INVENTION

The present invention discloses a structure that can be configured as a seat or as a bed and is convertible between the two configurations. The structure of the present invention includes a base, a seat frame, and a back frame, with the seat frame and the back frame resting on and connected to the base. The seat frame and back frame are connected to the base in such fashion that when the structure is being converted from a seat configuration to a bed configuration and vice versa, the back frame will not move rearwardly in relationship to the base, thus allowing the structure to be placed against a wall and converted from a seat configuration to a bed configuration and vice versa without having to move the base away from the wall.

The connection between the seat frame and the base frame is unique in that it allows a stable connection between the two frames while the structure is in a seat configuration, allows the seat to be moved forwardly and backwardly for different lounge positions, and allows the seat to be rotated about its pivot pin and placed in a horizontal position with a rigid connection between the seat frame and back frame so that danger of collapse of the bed is eliminated. The unique connection between the seat frame and the back frame includes a slotted side rail on the seat frame, a pivot pin that travels within the slot so as to disengage the side rail from contact with a dowel protruding inwardly from the end rails of the back frame to permit the structure to be configured as a bed or alternatively, allowing the pivot pin to move in the slot in the side rail so that the dowel engages a cam provided on the top of the side rail to create a fixed connection between the seat frame and the back frame in the seating configuration.

Having briefly described the invention, it will be apparent that it is an objective of this invention to provide a unique structure which can serve as a seat or as a bed and which can be easily converted between the two configurations.

It is a further object of the invention to provide a structure that has a unique connection between the seat frame and the back frame which will provide for a fixed connection between the two in both the seat configuration and the bed configuration.

It is a further object of this invention to provide a unique connection structure between the seat frame and the back frame which is simple to manufacture, inexpensive to manufacture, and easily assembled.

It is a further object of the present invention to provide a structure with a connection between the seat frame and the back frame that will prevent the structure from collapsing when one is seated in the structure when it is in the seat configuration or when lying on the structure when the structure is in the bed configuration.

There will be other unique advantages and features of the present invention that will become more readily apparent when the detailed description of the preferred embodiment of the invention is considered in connection with the drawings accompanying this application.

A BRIEF DESCRIPTION OF THE DRAWINGS

The drawings which illustrate the preferred embodiment of this invention, wherein like reference numbers note like parts in various figures, are as follows.

A DETAILED DESCRIPTION OF A PREFERRED EMBODIMENT OF THE INVENTION

The structure of the present invention can be made in any number of sizes and shapes. Generally, the structure can be of a size of either a chair or sofa when configured as a seat and can be either a single bed or double bed or larger when configured as a bed. The general shape of the structure with a futon in place can be seen in FIG. 1 of U.S. Pat. No. 4,996,730 to which reference can be made for a general description to the type of structure contemplated by the present invention.

Figure 1:
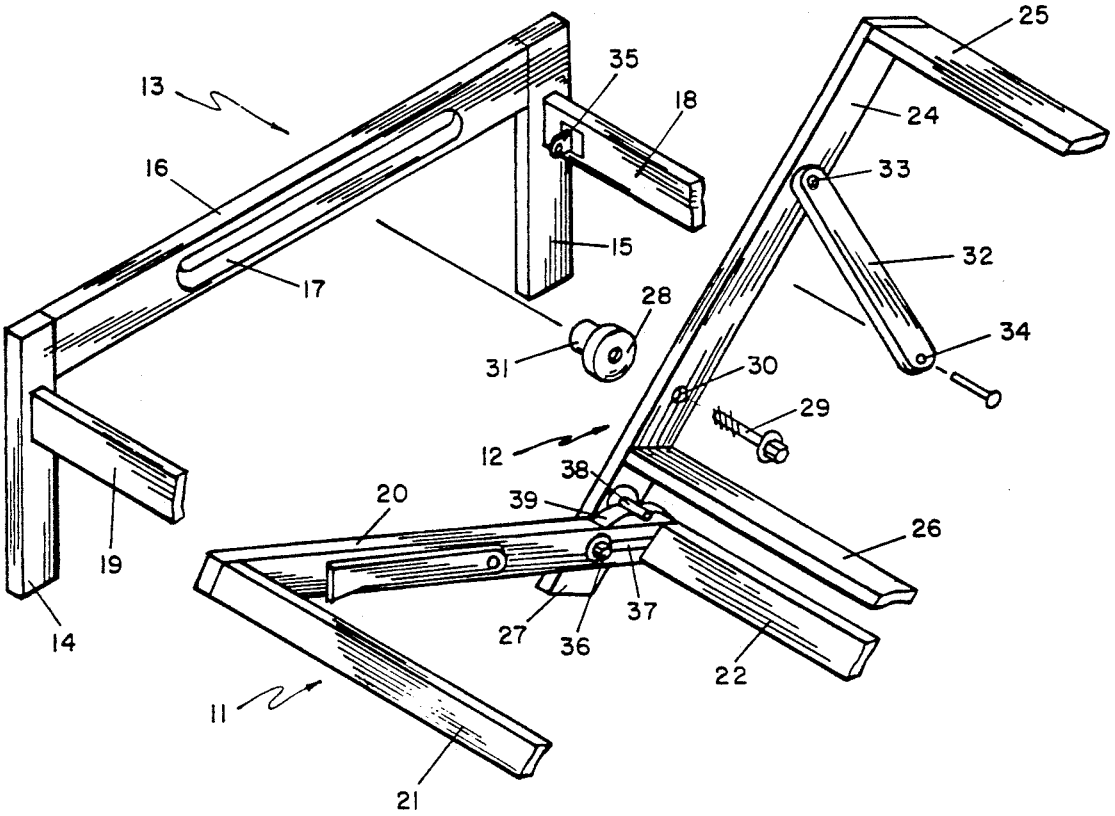
FIG. 1 is the perspective view of a break away section of the frame showing the base separated from but aligned with the seat frame and back frame.

The details of the preferred embodiment of the present invention are illustrated in the accompanying drawings with FIG. 1 showing a cut-away of the structure in an exploded view to allow a greater understanding of its operation. Referring to FIG. 1, one can see that the preferred embodiment of the invention includes a seat frame 11 and back frame 12 which are connected to and rest upon a base 13. The base 13 has front legs 14 and rear legs 15 which are connected and held in a spaced relationship by connector rail 16. The length of the connector rail 16 may vary and will determine, when considered in conjunction with the length of the Seat frame 11 and back frame 12 whether or not the frame can be used as a single bed, double bed, or greater.

The connector rail 16 is spaced from and connected to a second connector rail 16' by a rear cross piece 18 and a front cross piece 19. The connector rail 16 has formed in it an elongated slot 17. Normally, connector rail 16' is also provided With an elongated slot 17', all as can more readily seen from FIG. 3.

Figure 3:
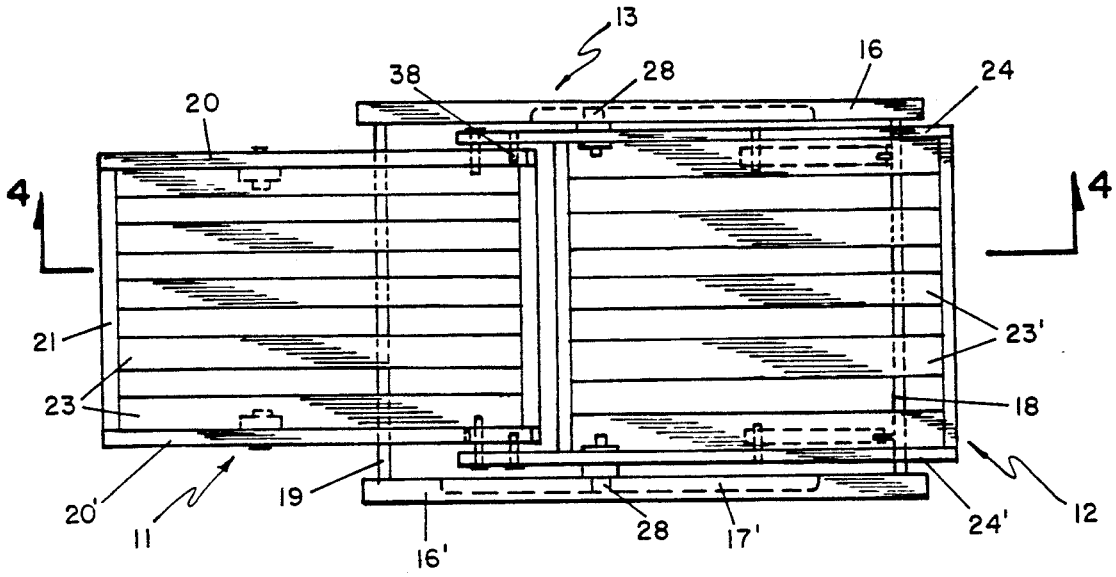
FIG. 3 shows a side sectional view of the structure in a seat configuration.

The seat frame 11 is generally either a rectangle as shown in FIG. 3 which creates either a chain or a single bed, or a rectangle having its length running from side to side (rather than from front to back), which creates either a sofa or a double bed. The seat frame 11 consists of side rails 20 and side rails 20', forward rail 21, and rear rail 22. The seat frame 11 will generally be provided with slats 23 (see FIG. 3, not shown in FIG. 1) or a webbing material which will allow the futon cushion, or other mattress structure to be placed on the seat of the present invention.

The back frame 12 is also generally a rectangular structure containing end rails 24 and 24', a top rail 25, and a bottom rail 26. The end rails 24 and 24' extend beyond the bottom rail 26 to provide a mounting arm 27 for the connection between the seat frame 11 and back frame 12.

Once again, the back frame 12 is covered with slats 23' (not shown in FIG. 1) to provide the support for a futon cushion mattress or the like.

Figure 2:
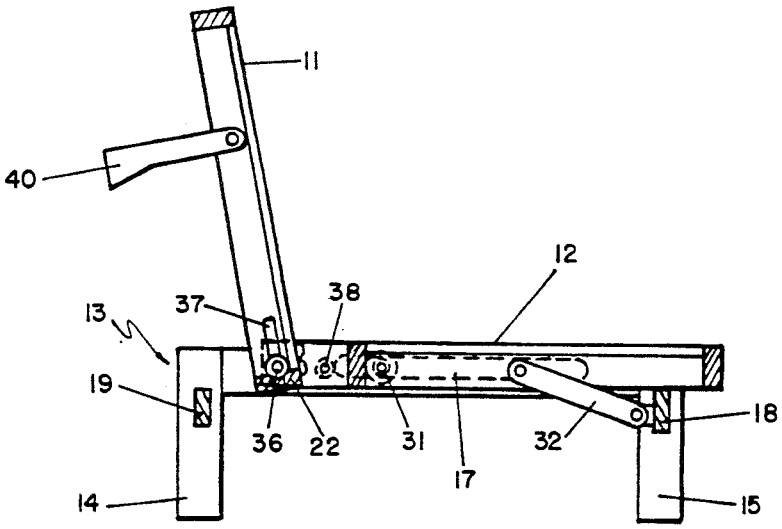
FIG. 2 shows a side sectional view of the structure in transition from a seat configuration to a bed configuration.

The back frame 12 is connected to the base 13 by virtue of means connecting the end rail 24 and 24' to the connector rails 16 and 16' respectively. The preferred means for connecting the back frame 12 to the base 13 are hardened plastic bearings 28 which are connected to end rails 24 and 24' by a bolt 24 passing through a hole 30 in the end rail 24 then passing through the bearing 28. The bearing 28 may have a counter sunk opening in the outer end thereof to allow a nut or other cap (not shown) to be placed on the bolt 29 to connect the bearing 28 to the end rail 24. The bearing 28 is allowed to rotate freely about the bolt 29 and the end 31 of the bearing 28 fits within the elongated slot 17 and is allowed to travel back and forth in that slot as the frame is converted from seat configuration to bed configuration and vice versa. The means for connecting the back frame to the base also includes a support arm 32 which is pivotally connected at 33 to the end rail 24 and also pivotally connected at 34 to a bracket 35 which is mounted on the rear cross piece is. By this means of connection of the back frame 12 to the base 13, any movement of the back frame 12 from the upright position as shown in FIGS. 1 and 5 to the horizontal position as shown in FIGS. 2 and 3 is a controlled movement that limits any backward thrust of the top rail 25.

Figure 4:
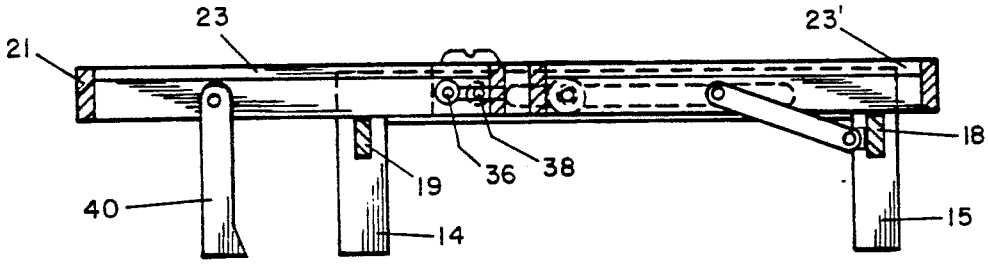
FIG. 4 shows a side sectional view of the structure in a bed configuration.
Figure 5:
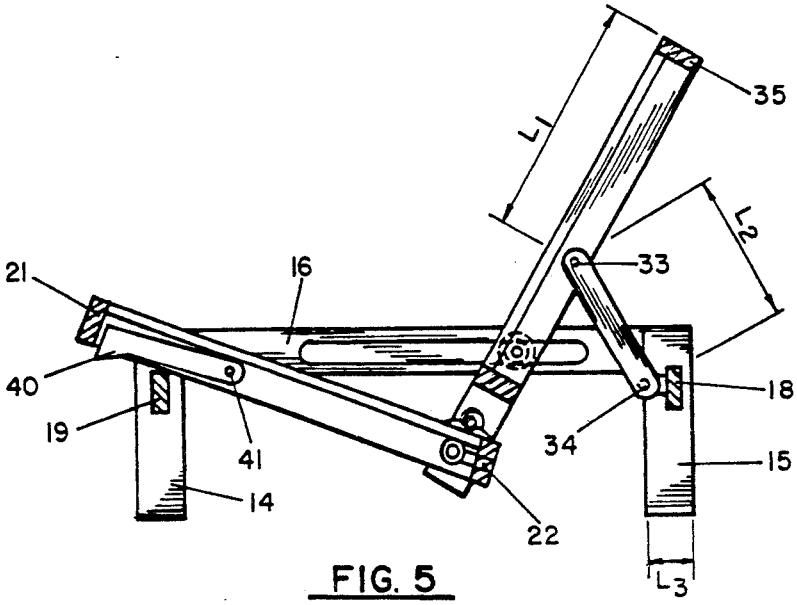
FIG. 5 shows a plain view of the structure in a be configuration.

As can be more clearly seen from FIGS. 4 and 5, the distance L1 from the pivot point 33 to the outside portion of top rail 25 must be controlled in relationship to the distance L2 between pivot point 33 and pivot point 34. The distance L3 of the pivot point 34 from the rear most portion of rear leg 15 is also a factor in determining the relative lengths of the various parts. Specifically, the extent that L1 exceeds the sum of L2 plus L3 will determine how far the rear most portion of back frame 12 extends beyond the rear most portion of the rear leg 15. This relationship will affect the extend to which the structure may be placed against a wall because if L1 equals L2 plus L3, the base 13 may be placed directly against a wall with the rear legs pressed against the wall. By controlling these relative distances, the structure, as can be seen more clearly in the remaining description of this preferred embodiment, can be converted from a seat configuration to a bed configuration without the rear most portion of back frame 12 extending beyond the rear most portion of the rear legs 15 to mar or scrape against the wall. This arrangement obviates any need to move the frame 13 away from the wall when converting the structure from a seat configuration to a bed configuration.

Turning now to the connection between the seat frame 11 and the back frame 12, as can be seen from FIG. 1, the mounting arm 27 extends beyond the bottom rail 15 and pivot pin 36 connects the end rail 24 to the side rail 20. The pivot pin 36 fits in slot 37 formed at the rear portion of the side rail 20 allowing the seat frame to move not only pivotally about the pivot pin 36 but radially in relationship to the pivot pin 36 by traversing along the slot 37. A nut or other convenient structure is provided on the end of pivot pin 36 so that the seat frame can not be disconnected from the back frame when the seat frame is pulled radially of the pivot pin 36 because the nut will hit against the inner surface of the rear rail 22 when the pivot pin 36 traverses the slot 37 to its rear most position.

When the structure is in the seat configuration and the seat frame 11 is pushed rearwardly against the back frame 12, a dowel 38 protruding inwardly from end rail 24 fits in cam 39 mounted on the upper surface of side rail 20. The inner connect between pivot pin 36 fitted within slot 37 and the dowel 38 resting in cam 39 creates a leverage effect which provides a fixed relationship between the seat frame 11 and back frame 12. The cam 39 is preferable constructed of a hardened plastic or other material that will endure the pressure and the wear created by the leverage force against the dowel 38 when someone is seated on the front of seat frame 11.

The pivot pin 36, slot 37, and dowel 38 form means allowing the seat frame 11 to move both pivotally about its point of connection to the back frame 12 as well as radially in reference to the point of connection to the back frame 12.

In operation, when the structure is configured as a seat or sofa as shown in FIGS. 1 and 4, the seat frame 11 is pushed rearwardly with the pivot pin 36 being in the forward most section of the slot 37 and the dowel 38 resting on the cam 39. The bearings 28 are fitted within the elongated slot 17 and the support arm 32 connects the end rail 24 to the rear cross piece 18. The side rail 20 rests on front cross piece 19 as can be seen in both FIG. 1 and 4, and the extension leg 40 rests on front cross piece 19. The structure in the seat configuration can function as a recliner with the seat being adjustable from a practically upright position when the bearing 28 is at the rear most position in the elongated slot 17 and adjustable to a reclined position when the bearing 28 is pushed forward in the elongated slot. As the bearing moves forward in the elongated slot 17, the seat moves through a variety of positions.

When one desires to change the configuration of the structure from a seat to a bed, the seat frame is pulled forward and upwardly into the position shown in FIG. 3. At this point, the extension legs 40, which are pivotally connected at 41 to the side rail 20, pivot into the position shown in FIG. 2 by the force of gravity. The base of the extension leg 40 will wedge against the underside of slat 23 to limit its rotation to a position perpendicular to the side rail 20.

Once the structure is rotated to the position shown in FIG. 2, an upward pull on the seat frame 11 will cause the seat frame to move radially in relation to the pivot pin 36. The dowel 38 will disengage from the cam and clear the rear most portion of the rear rail 22. The seat frame 11 is prevented from disengaging from the back frame 12 because the nut or other device capping the pivot pin 36 will engage the forward most portion of the rear rail 22. When the seat frame 11 is pulled upwardly to disengage the dowel 38 from the cam 39 and the pivot pin 36 moves to the rear most position of the slot 37, the seat frame 11 may then be rotated about the pivot pin 36 until the seat frame is in a horizontal position in the same plain as the back frame 12.

Referring now to FIG. 4, once the seat frame 11 has been rotated about the pivot pin 36 to the horizontal position, the seat frame 11 is pushed rearwardly toward the back frame 12 and the dowel 38 enters the slot 37 formed in the end of side rail 20. With the pivot pin 36 and the dowel 38 in the slot 37, a fixed connection is created between the seat frame 11 and the back frame 12. The structure is now in the bed configuration with the extension leg 40 resting on the floor as is shown in FIG. 4. A secure connection between the seat frame and the back frame forming a horizontal support for a futon, cushion, mattress, or similar structure.

When one desires to convert the structure from a bed configuration to a seat configuration, the process is simply reversed. Specifically, the seat frame is pulled forward from the position shown in FIG. 4 to disengage the dowel 38 from the slot 37. This will cause the pivot pin 36 to be butted against the forward most surface of the rear rail 22 with the dowel 38 clearing the rear most portion of the side rail 20. The seat frame 11 may then be rotated about the pivot pin 36 to the point where the dowel pin 38 clears the top of the side rail 20 as shown in FIG. 2. The seat frame is then allowed to drop with the pivot pin 36 traversing through the slot 37. At this point, the dowel 38 engages the cam 39 to create an engagement between the seat frame 11 and the back frame 12. The seat frame is then pushed downwardly and the force of the pivot pin 36 against the forward most portion of the slot 37 and the engagement between the dowel 38 and the cam 39 cause the underside of the rail 20 to ride along the front cross bar 19. The bearing 28 moves rearwardly in the elongated slot 17 and the support arm 32 pivots upwardly about pivot point 34 with the movement of the back frame into the position shown in FIG. 5.

The terms and expressions which are employed to describe the preferred embodiment of my invention are simply terms of description. It is recognized however that various modifications are possible. The claims of this application, to the extent reasonably contemplated by the language employed, are intended to cover all modifications of the specific descriptive terms used to illustrate the preferred embodiment of the invention.

Without limiting the generality of the foregoing, what is claimed is:

1. A convertible sofa bed recliner which can be converted from a seating configuration to a bed configuration including:

a. a base;

b. a seat frame with side rails;

c. a back frame with end rails;

d. means connecting the back frame to the base which permit movement of the back frame from an upright position to a horizontal position and vice versa:

e. means controlling the movement of the back frame in relationship to the base to prohibit the rear most portion of the back frame from extending rearwardly relative to the base at any time during the path of travel of the back frame from an upright position to a horizontal position and vice versa;

f. means connecting the seat frame to the back frame include a slot in each of the side rails, and pivot pins connecting the end rails to the side rails, the pivot pins passing through the slots allowing the seat frame to rotate about the pivot pins and to move radially of the pivot pins;

g. a dowel protruding from at least one of the end rails; and h. the dowel aligned to fit within one of the slots in the side rails when the sofa bed recliner is in the bed configuration.

2. A convertible sofa bed recliner which can be converted from a seating configuration to a bed configuration including:

a. a base;

b. a seat frame with side rails;

c. a back frame with end rails;

d. means connecting the back frame to the base which permit movement of the back frame from an upright position to a horizontal position and vice versa;

e. means controlling the movement of the back frame in relationship to the base to prohibit the rear most portion of the back frame from extending rearwardly relative to the base at any time during the path of travel of the back frame from an upright position to a horizontal position and vice versa;

f. means connecting the seat frame to the back frame including a slot in each of the side wails, and pivot pins connecting the end rails to the side rails, the pivot pins passing through the slots allowing the seat frame to rotate about the pivot pins and to move radially of the pivot pins;

g. a dowel protruding from at least one of the end rails; and h. the slots in the side rails extend to the ends of the side rails creating an opening in the ends of the side rails into which the dowel can fit when the sofa bed recliner is in a bed configuration to allow a fixed connection between the seat frame and the back frame.

3. The convertible sofa bed recliner as defined in claim 2 wherein the seat frame includes a rear rail connecting the side rails and the rear rail serves as a stop to prevent the pivot pins from passing through the slots in the side rails and disengaging the seat frame from the back frame.

* * * * *